US005529643A

United States Patent [19]

Yoon et al.

[11] Patent Number: 5,529,643

[45] Date of Patent: Jun. 25, 1996

[54] METHOD FOR MINIMIZING NONUNIFORM NUCLEATION AND SUPERSOLVUS GRAIN GROWTH IN A NICKEL-BASE SUPERALLOY

[75] Inventors: Duk Y. Yoon, Seoul, Rep. of Korea; Aldo E. Murut; Michael F. Henry, both of Schenectady, N.Y.; Renee M. Rohling, Burnt Hills, N.Y.; Charles P. Blankenship, Niskayuna, N.Y.; Mark G. Benz, Burnt Hills, N.Y.; Edward L. Raymond, Maineville; Eric S. Huron, West Chester, both of Ohio

[73] Assignee: General Electric Company, Cincinnati, Ohio

[21] Appl. No.: 323,969

[22] Filed: Oct. 17, 1994

[51] Int. Cl.[6] ..... C22F 1/10

[52] U.S. Cl. ..... 148/514; 148/677; 148/556; 419/28; 419/29; 419/67

[58] Field of Search ..... 419/28, 29, 67, 419/41; 148/675, 676, 677, 555, 556, 514

[56] References Cited

U.S. PATENT DOCUMENTS 4,957,567 9/1990 Krueger et al. ..... 148/675

5,393,483 2/1995 Chang ..... 148/677

5,413,752 5/1995 Kissinger ..... 419/28

*Primary Examiner*—Melvyn Andrews

*Assistant Examiner*—Margery S. Phipps

*Attorney, Agent, or Firm*—Andrew C. Hess; David L. Narciso

[57] ABSTRACT

A method is provided for obtaining uniform grain growth within γ' precipitation strengthened nickel-base superalloys. The method includes forming a billet having a very fine grain size in order to achieve optimum superplasticity of the superalloy during forging. The article is then heated to a pre-working hold temperature in a manner which prevents coarsening of the microstructure and a loss of superplasticity. The article is then worked, such as by forging, at a temperature below the γ' solvus temperature of the alloy, so as to maintain local strain rates within the article below a critical strain rate for random grain growth, and so as to maintain the strain rate gradient throughout the article below a critical upper limit. After working, the article is subjected to annealing at a temperature which is less than the γ' solvus temperature of the alloy, and for a duration which is sufficient to remove accumulated metallurgical strain in the article. A supersolvus heat treatment is then performed by further heating the article to a temperature above the Γ' solvus temperature of the superalloy for a duration sufficient to uniformly coarsen the grains of the article.

20 Claims, No Drawings

METHOD FOR MINIMIZING NONUNIFORM NUCLEATION AND SUPERSOLVUS GRAIN GROWTH IN A NICKEL-BASE SUPERALLOY

This invention relates to methods for processing nickel-base superalloys. More particularly, this invention is directed to a method for producing an article from a nickel-base superalloy, in which nonuniform nucleation tendencies are minimized and grain growth is controlled in the alloy during supersolvus heat treatment, so as to yield an article characterized by a uniformly-sized grain microstructure.

BACKGROUND OF THE INVENTION

The material requirements for gas turbine engines are continually being increased. Components formed from powder metal gamma prime ($\gamma'$) precipitation strengthened nickel-base superalloys can provide a good balance of creep, tensile and fatigue crack growth properties to meet these performance requirements. Typically, a powder metal component is produced by some form of consolidation, such as extrusion consolidation. The resulting billet is then isothermally forged at temperatures slightly below the $\gamma'$ solvus temperature of the alloy to approach superplastic forming conditions, which allows the filling of the die cavity through the accumulation of high geometric strains without the accumulation of significant metallurgical strains. These processing steps are designed to retain a fine grain size within the material, avoid fracture during forging, and maintain relatively low forging loads. In order to improve the fatigue crack growth resistance and mechanical properties of these materials at elevated temperatures, these alloys are then heat treated above their $\gamma'$ solvus temperature (generally referred to as supersolvus heat treatment), to cause significant, uniform coarsening of the grains.

However, during conventional manufacturing procedures involving hot forging operations, a wide range of local strains and strain rates may be introduced into the material which cause non-uniform critical grain growth during post forging supersolvus heat treatment. Critical grain growth as used herein refers to localized abnormal excessive grain growth in an alloy which results in the formation of grains whose diameters exceed a desired grain size range for an article formed from the alloy. Accordingly, the term "uniform" with respect to grain size and growth refers to the substantial absence of critical grain growth. Desired ranges for gas turbine engine components often entail grain sizes of ASTM 9 and coarser, but are generally limited to a range of several ASTM units in order to be considered uniform. (Reference throughout to ASTM grain sizes is in accordance with the standard scale established by the American Society for Testing and Materials.)

The presence of grains within a component which significantly exceed the desired grain size range are highly undesirable, in that the presence of such grains can significantly reduce the low cycle fatigue resistance of the article and can have a negative impact on other mechanical properties of the article, such as tensile and fatigue strength. As an example, if the desired grain size range for a nickel-base superalloy article is ASTM 7 to ASTM 8, random grain growth which produces grains coarser than about ASTM 4 will often be undesirable.

The propensity for critical grain growth increases if more conventional cast and wrought processing or spraycast forming techniques are used to form such components. As such, critical components are generally formed from powder metallurgy particles which have been extrusion consolidated. However, even these components are susceptible to critical grain growth during supersolvus heat treatment, particularly if the component has an extremely complex shape or is formed by friction welding two or more components together, as in the case of some turbine disks.

U.S. Pat. No. 4,957,567 to Krueger et al., assigned to the same assignee of the present patent application, eliminates critical grain growth in fine grain nickel-base superalloy components by controlling the localized strain rates experienced during the hot forging operations. Krueger et al. teach that, generally, local strain rates must remain below a critical value, $\epsilon_c$, in order to avoid detrimental critical grain growth during subsequent supersolvus heat treatment. Strain rate is defined as the instantaneous rate of change of geometric strain with time.

However, critical grain growth can occur if the processing parameters of the alloy during forging and heat treatment are not properly controlled. As such, the process window for many components is relatively narrow, resulting in increased costs due to scrappage. Accordingly, it would be desirable to identify processing parameters which further enable the production of nickel-base superalloy articles having a uniform grain microstructure, so as to enhance the processibility of nickel-base superalloys in order to achieve desirable microstructures.

SUMMARY OF THE INVENTION

It is an object of this invention to provide a method for making an article from a precipitation strengthened nickel-base superalloy, wherein processing steps are employed which minimize both nonuniform nucleation and grain growth tendencies in the alloy during supersolvus heat treatment of the alloy.

It is a further object of this invention that such a method entail processing steps which minimize nonuniform nucleation tendencies by removing stored strain energy within the microstructure of the alloy prior to supersolvus heat treatment, and which minimize grain growth tendencies through appropriate processing controls imposed prior to and during the forging operation.

It is still a further object of this invention to provide a method by which complex shapes can be more readily produced from a precipitation strengthened nickel-base superalloy.

Lastly, it is yet an another object of this invention that such methods be adaptable for working precipitation strengthened nickel-base superalloys, having about 30–65 volume percent $\gamma'$ content, so as to form articles which may be useful, after appropriate heat treatment, at temperatures up to about 1500° F.

The present invention provides a method for obtaining uniform grain microstructures within $\gamma'$ precipitation strengthened nickel-base superalloys. This method is particularly useful for forming components such as gas turbine compressor and turbine disk assemblies in which high localized strain rates commonly occur during a hot forging operation in which the components are formed. The method of this invention generally entails processing steps which achieve a desired microstructure for the alloy.

More specifically, initial processing of the alloy is performed so as to form an article having a very fine grain size in order to achieve sufficient superplasticity of the alloy during forging. Generally, an extrusion consolidation step or a hot isostatic pressing (HIP) consolidation forge working step can be employed whose parameters are maintained within a narrow range for temperature and ram speed to achieve the desired grain size. The article is then heated to a pre-working hold temperature in a manner which prevents coarsening of the microstructure and a loss of desirable superplasticity.

The article is then worked, such as by forging, at a temperature below the γ' solvus temperature of the alloy. During working, local strain rates within the article are maintained below a critical strain rate for random grain growth. In addition, and as a feature of this invention, the strain rate gradient throughout the article is also maintained below a critical upper limit. The worked article is also subjected to annealing at a temperature which is less than the γ' solvus temperature of the alloy, and for a duration which is sufficient to remove accumulated metallurgical strain, and therefore its associated stored energy, created within the article as a result of the forging process. It is believed that the removal of stored strain energy within the microstructure of the article by use of an appropriate subsolvus anneal, which apparently causes recovery of dislocations and/or recrystallization with the primary γ' controlling the resulting grain size, results in a significant reduction in the nonuniform nucleation tendencies of the superalloy, such that random grain growth in the article is reduced or prevented. However, the above explanation is only an hypothesis, and does not serve as a limitation on the scope of the present invention.

A supersolvus heat treatment is then performed by further heating the article to a temperature above the γ' solvus temperature of the superalloy for a duration sufficient to uniformly coarsen the grains of the article. Thereafter, the article is cooled at a rate sufficient to reprecipitate γ' within the article.

The method of this invention may further include alloying the nickel-base superalloy to contain at least about 0.030 weight percent carbon, in accordance with the teachings of copending U.S. patent application Ser. No. 08/293,343 to Raymond et al., assigned to the assignee of the present invention. Raymond et al. teach that carbon which is finely dispersed within the alloy using suitable processing methods, yields a carbide phase which restricts the grain boundary motion of the alloy during supersolvus heat treatment. Dispersion of the carbide phase can be achieved by rapid cooling a melt of the superalloy, as with powder metallurgy techniques or spraycast forming, or with extensive heating and working of a cast and wrought structure. The presence of the finely dispersed carbide phase discourages random grain growth during supersolvus heat treatment. Importantly, the subsolvus annealing step of this invention is tailored to maximize the benefit of this desirable carbide pinning effect.

The method of this invention results in superalloy articles which are characterized by a combination of high strength and tolerance to defects, and which are suitable for use at temperatures of up to about 1500° F. Yet, due to an enhanced resistance to critical grain growth, the superalloy articles are characterized by consistent fatigue crack growth resistance and mechanical properties at elevated temperatures. Furthermore, lower part rejection and scrap rate during production is achieved by the absence of critical grain growth in such articles. Articles which typically have been limited to powder metallurgy processing may also be formed by conventional cast and wrought processing and spraycast forming, and yet be produced to have the advantageous microstructure achieved by this invention.

DETAILED DESCRIPTION OF THE INVENTION

For γ' precipitation strengthened nickel-base superalloys, aluminum, titanium, tantalum, niobium and vanadium are the principal elements which combine with nickel to form the desired amount of γ' precipitate, principally $Ni_3(Al, Ti)$. The elements nickel, chromium, tungsten, molybdenum, rhenium and cobalt are the principal elements which combine to form the γ matrix. The principal high temperature carbide formed is of the MC type, in which M is predominantly niobium, zirconium and titanium. With this type of alloy, prior art processing methods have employed working parameters which provide a worked structure having a grain size not larger than about ASTM 10. After supersolvus heat treating, such worked structures preferably have a grain size on the order of about ASTM 2 to about ASTM 9.

It has been determined that when hot working this type of alloy at elevated temperatures at or near its recrystallization temperature, the grain growth during subsequent supersolvus heat treatment is strain rate dependent. The strain rate experienced during hot deformation (i.e., temperatures at or near the recrystallization temperature of the alloy but less than the γ' solvus temperature of the alloy) of a γ' precipitation strengthened nickel-base superalloy material is crucial to the development of beneficial, uniform grain growth within the material during subsequent supersolvus heat treatment. As previously taught by Krueger et al, which is incorporated herein by reference, the strain rate experienced during hot deformation must remain below a relatively low critical strain rate, $\epsilon_c$, so as to avoid nonuniform critical grain growth. Yet, critical grain growth may still occur unless the other processing parameters of the alloy during forging and heat treatment are properly controlled.

As a method by which critical grain growth can be further inhibited in a γ' precipitation strengthened nickel-base superalloy, the present invention identifies processing parameters which minimize the nonuniform nucleation and grain growth tendencies during the supersolvus heat treatment in order to prevent critical grain growth.

In particular, this invention entails forming a billet having a grain size of less than about ASTM 12, more preferably about ASTM 14 to 16, from a nickel-base superalloy in order to achieve optimum superplasticity. Whether formed by powder metallurgy, spraycast forming, cast and wrought, or other suitable methods, a billet of the superalloy must be formed under conditions within specified ranges for temperature to produce the desired fine grain size, as is known to those skilled in the art. In accordance with this invention, such parameters must also maintain the billet microstructure such that the billet has a minimum strain rate sensitivity of about m=0.3 within the forging temperature range.

Prior to working the billet, a forging preheat step is performed in a manner which prevents coarsening of the grains and a loss of the superplasticity which is advantageously achieved by the previous procedure. More particularly, the heating cycle must be carefully controlled to prevent coarsening of the overall grain size, which would reduce superplasticity. The billet is then worked so as to form an article having a desired geometry. Importantly, and in accordance with this invention, not only must local strain rates be maintained below a critical strain rate, but also the strain rate gradient throughout the billet must be maintained below a critical level.

As noted with the teachings of Krueger et al., the critical strain rate, $\epsilon_c$, during working, which is composition, microstructure and temperature dependent, may be determined for a selected alloy by deforming test samples under various strain rate conditions, and then heating the samples above the γ' solvus temperature and below the incipient melting temperature of the alloy. The supersolvus solution temperature for an alloy is typically about 50° F. above its γ' solvus temperature. $\epsilon_c$ is then defined as the strain rate which, when exceeded during the deformation and working of a superalloy article and accompanied by a sufficient amount of total strain, will result in critical grain growth after supersolvus heat treatment. In accordance with the present invention, in which the strain rate gradient within the article has also been identified as being critical to controlling grain growth, exceeding a critical strain rate gradient during the deformation and working of a superalloy article can also result in critical grain growth after supersolvus heat treatment. The precise limit for this parameter may vary depending on the composition and microstructure of the article in question.

After hot working, the superalloy article undergoes an extended subsolvus annealing process which is sufficient to dissipate stored strain energy within the article, while also equilibrating the temperature of the article. As a result of the dissipation of stored strain energy, nonuniform nucleation tendencies of the superalloy are significantly reduced, such that the tendency for random grain growth in the article is also reduced. When an optimum time and temperature relationship exists, the combination of removing stored strain energy and retaining the pinning carbide phase results in C-curve kinetics, such as that observed for many nucleation and growth metallurgical processes. In particular, it has been determined that an excessively low temperature or short duration for the subsolvus annealing process will fail to remove sufficient energy and fail to promote sufficient carbide precipitation, while an excessively high temperature or long duration will serve to remove energy but allow normal grain growth and carbide coarsening.

Finally, the article is fully solutioned, except for the high temperature carbides, at a supersolvus temperature while the worked grain structure simultaneously recrystallizes and coarsens uniformly to the desired grain size. For optimum mechanical properties, uniform grain sizes within a range of about 2 or 3 ASTM units are desirable, while grain sizes in excess of about 2 to 3 ASTM units coarser than the desired grain size range are undesirable in that the presence of such grains can significantly reduce the low cycle fatigue resistance of the component and can have a negative impact on other mechanical properties of the component, such as tensile and fatigue strength. For example, an article having a desired grain size range of about ASTM 7–8 should be free of grains larger than ASTM 4 (though widely scattered grains as large as about ASTM 2 may be tolerable), and an article having a desired grain size range of about ASTM 2–4 should be free of grains of as large as about ASTM 00.

Following the supersolvus heat treatment, the cooling rate is then appropriately controlled to reprecipitate γ' within the γ matrix and grain boundaries, so as to achieve the particular mechanical properties desired.

To further reduce grain growth tendencies, relatively high levels of carbon may be employed in a γ' precipitation strengthened nickel-base superalloy processed in accordance with this invention. As taught by copending U.S. patent application Ser. No. 08/293,343 to Raymond et al., carbon in the form of finely dispersed carbides can serve to control grain growth during supersolvus heat treatment of the superalloy, such that critical grain growth is substantially prevented. Generally, a carbon content of at least about 0.030 weight percent has been determined to have a significant influence in the control of grain growth. Carbon at such levels is believed to provide adequate pinning force required to prevent abnormal grain growth. Generally, as finely dispersed carbides, grain boundary motion during supersolvus heat treatment is restricted, such that the grains are not permitted to grow randomly. Notably, and in accordance with Raymond et al., an increased carbon content works in parallel with the subsolvus anneal, in that about 0.045 weight percent carbon in a γ' precipitation strengthened nickel-base superalloy requires a shorter subsolvus anneal duration than the same alloy containing about 0.030 weight percent carbon.

In a specific example illustrating the processing features of this invention, a γ' precipitation strengthened nickel-base superalloy, herein called Alloy A, is employed which has a nominal composition, in weight percent, of about 12.0 to about 14.0 cobalt (Co), about 15.0 to about 17.0 chromium (Cr), about 3.5 to about 4.5 molybdenum (Mo), about 1.5 to about 2.5 aluminum (Al), about 3.2 to about 4.2 titanium (Ti), about 0.5 to about 1.0 niobium (Nb), about 0.01 to about 0.06 zirconium (Zr), about 0.01 to about 0.1 carbon (C), about 0.01 to about 0.04 boron (B), up to about 0.3 hafnium (Hf), up to about 0.01 vanadium (V), and up to about 0.01 yttrium (Y), with the balance being essentially nickel (Ni) and incidental impurities. The recrystallization temperature of this alloy is approximately 1900° F., its γ' solvus temperature is estimated to be in the range of about 2000° F.–2100° F. and its incipient melting point is estimated to be in the range of about 2200° F.–2250° F. The calculated γ' content for Alloy A is from about 33 to about 46 volume percent. Although data were gathered on Alloy A, the teachings of this invention are believed to be applicable to γ' precipitation strengthened nickel-base superalloys in general.

The processing of Alloy A may include powder metallurgy, spraycast forming, or cast and wrought methods. To produce a fine dispersion of carbide particles in the alloy in accordance with Raymond et al., it is necessary that a melt of the alloy be rapidly solidified, as is possible with conventional powder metallurgy and spraycast forming techniques, or some other suitable rapid solidification processing, or extensive heating and working of a cast and wrought structure. For optimum properties, powder metallurgy particles are formed in a conventional manner by rapidly cooling a melt of Alloy A.

In accordance with this invention, billets can then be produced using extrusion conditions within a specified range for temperature and ram speed to produce a very fine grain size of less than about ASTM 12, and more preferably about ASTM 14 to 16, so as to achieve optimum superplasticity. A preferred extrusion temperature is about 1850° F. to about 2000° F., while the ram speed must be sufficiently low to prevent adiabatic heating of the material, limited only by equipment tonnage limitations and excessive chilling. Otherwise, relatively conventional extrusion consolidation methods are employed, such as a 6:1 reduction in area, so as to yield a fully dense, fine grain billet preferably having at least about 98% theoretical density. The billet is then heated to a temperature of about 75° F. to about 175° F. below the γ' solvus temperature (about 1890° F. to about 1950° F. for Alloy A) for a duration of not more than about 25 hours, such that coarsening of the grains does not occur in the billet, leading to a subsequent loss of superplasticity during forging. It is foreseeable that a soak time of more than 25 hours could be employed if done in conjunction with an appropriate modification of the processing parameters.

An article is then isothermally forged from the billet by hot upsetting the billet at a working temperature below the γ' solvus temperature, such as about 1900° F. to about 1950° F., so as to achieve a local strain rate of not more than about 0 032 $sec^{-1}$ and preferably not more than about 0.01 $sec^{-1}$, while also maintaining the strain rate gradient throughout the billet below a critical level.

In accordance with this invention, exceeding the critical strain rate gradient level during the deformation and working of the superalloy billet can promote critical grain growth during supersolvus heat treatment. It is believed that the precise limit for this parameter may vary depending on the composition and microstructure of the billet in question. However, in the forging of billets formed from Alloy A in which a nominal strain of 0.7 has been achieved, a strain rate gradient on the order of above about 0.2 inch/inch per second-inch has resulted in localized critical grain growth, while strain rate gradients of below this approximate value have not resulted in localized critical grain growth.

Once forged in accordance with the above, a grain size of not larger than about ASTM 10 to 12 is preferably achieved in the article. The as-forged article is then subjected to a post-forging subsolvus anneal step by being heated to a hold temperature which is below the γ' solvus temperature for the alloy. It is believed that the hold temperature should be on the order of about 50° F. to about 200° F. below the γ' solvus temperature of the alloy, with a preferred hold temperature for Alloy A being about 1925° F to about 1950° F. The article is maintained at the hold temperature for an extended duration which, according to the hypothesis proposed by this invention, is sufficient to allow stored strain energy within the article to be dissipated, while also reprecipitating the beneficial carbide phase. A duration of at least about 8 hours is required, with a maximum duration being about 96 hours in order to prevent overall coarsening of the grains.

Notable features of the above subsolvus anneal process taught by this invention is that the hold temperature is below the γ' solvus temperature of the alloy, and is maintained for a prolonged period of time. The degree to which this subsolvus anneal step is able to inhibit critical grain growth in a superalloy during supersolvus heat treatment was previously unknown and unexpected. In testing conducted with articles forged from Alloy A in accordance with this invention, critical grain growth was often completely absent for specimens forged above the critical strain rate, $\epsilon_c$, if then annealed at 1925° F. for a duration of at least about 8 hours. Though the precise mechanism or mechanisms by which these improvements are achieved is unclear, it is believed that a reduction in stored strain energy occurs within the forged article, in which recovery of the dislocations occurs and/or recrystallization occurs with the primary γ' controlling the resulting grain size.

It was determined that the subsolvus annealing process of this invention can advantageously interact with the carbide phase to produce a maximum γ' volume fraction with minimum interparticle spacing and minimum particle diameter. Annealing at lower temperatures or for shorter periods than that taught by this invention failed to promote sufficient energy removal or carbide precipitation, while higher temperatures and longer durations resulted in excessive carbide coarsening.

Following the subsolvus anneal cycle, a supersolvus heat treatment is then performed by further heating the article from the anneal temperature to a temperature above the γ' solvus temperature of the superalloy, generally on the order of about 50° F. to about 150° F. above the γ' solvus temperature of the alloy (with a preferred temperature of about 2100° F. for Alloy A), for a duration, generally about 1 hour, which is sufficient to uniformly coarsen the grains of the article to at least about ASTM 9. More particularly, uniform grain sizes are produced within a range of about 2 or 3 ASTM units, with grain sizes in excess of about 2 to 3 ASTM units coarser than the desired grain size range being absent so as to achieve optimal mechanical properties, such as low cycle fatigue resistance and tensile and fatigue strength.

Thereafter, the article is preferably air cooled for a brief period on the order of a few seconds to a few minutes, and then quenched in oil or another suitable medium so as to reprecipitate γ' within the article, as is known in the art. In addition, the article may be aged using known techniques with a short stress relief cycle at a temperature above the aging temperature of the alloy if necessary to reduce residual stresses. As is known by those skilled in the art, such stress relief has the added benefit of improving long term carbide stability during service. The resulting article generally has a stabilized microstructure and an enhanced, attractive balance and combination of tensile, creep, stress rupture, low cycle fatigue and fatigue crack growth properties, particularly for use from ambient up to a temperature of about 1500° F. The aging process required for a particular material and properties would be known to one skilled in the art and will not discussed further.

The method of this invention makes possible the production of components from a γ' precipitation strengthened nickel-base superalloy at potentially lower costs. While powder metallurgy techniques are generally preferred, the method of this invention enables the production of articles which are substantially free of critical grain growth, yet formed by less costly methods, such as spraycast forming techniques or extensively worked cast and wrought structures. Where a welded article is to be formed, the above process can be modified slightly to achieve similar results. For example, a welded article can be formed by welding together two or more isothermally forged articles processed in accordance with the above. The previously described controlled extrusion, forging, annealing, and supersolvus heat treatment are then be performed, either on the entire welded article or locally in the weld region defined by the articles used to form the welded article.

From the above, it can be seen that the method of this invention for making γ' precipitation strengthened nickel-base superalloy articles from either powder metal, spraycast or cast and wrought material, serves to optimize the resultant worked microstructure after supersolvus heat treatment. By employing the processing techniques described, the grains are coarsened uniformly during subsequent heat treatment at the supersolvus solutioning temperature, and critical grain growth within the material is substantially prevented, such that grain size can be controlled within a range of not more than a few ASTM units.

The method of this invention is also applicable to a wide range of starting input materials, including hot compacted powder, fine grain powder metal billet, coarse grain powder metal billet produced by supersolvus heat treatment of fine grain billet, as well as cast and wrought materials. In addition, the composition of the γ' precipitation strengthened nickel-base superalloy may vary widely so as to include alloys of this type having calculated high volume fractions of γ' content, varying from about 30 to about 65 volume percent. In addition, other processing techniques of high volume fraction γ' superalloys, besides the powder metallurgy and hot forging operations disclosed, may be employed, such as using hot isostatically pressed powder, rapidly solidified materials, or fine grain wrought materials.

The teachings of this invention are advantageous in that components, such as turbine disks, fasteners and high pressure compressor blades and vanes, can be produced which are characterized by uniform grain size so as to have consistent strength, fatigue and creep resistance. These teachings can be extended to other applications requiring enhanced properties at temperatures ranging from ambient up to about 1500° F.

While our invention has been described in terms of a preferred embodiment, it is apparent that other forms could be adopted by one skilled in the art, such as by substituting other γ' precipitation strengthened nickel-base superalloys, or by modifying the preferred method by substituting other processing steps or including additional processing steps. Accordingly, the scope of our invention is to be limited only by the following claims.

What is claimed is:

1. A method for forming an article from a γ' precipitation strengthened nickel-base superalloy having a γ' solvus temperature, the method comprising the steps of:

forming a billet having a very fine grain size of less than about ASTM 12 in order to achieve superplasticity of the superalloy during a subsequent working step;

heating the billet to a pre-working hold temperature and maintaining the pre-working hold temperature for a duration which prevents coarsening of the microstructure and a subsequent loss of superplasticity;

working the billet at a temperature below the γ' solvus temperature of the alloy so as to form a worked article, wherein the billet is worked so as to maintain local strain rates below a critical strain rate for random grain growth, and so as to maintain the strain rate gradient throughout the billet below a critical upper limit;

annealing the worked article at an annealing temperature which is less than the γ' solvus temperature of the alloy, and for a duration of at least about 8 hours;

heat treating the worked article to a temperature above the γ' solvus temperature of the superalloy for a duration sufficient to uniformly coarsen the grains of the article; and cooling the worked article at a rate sufficient to reprecipitate γ' within the worked article;

whereby nonuniform nucleation tendencies of the superalloy are significantly reduced so as to prevent random grain growth in the article.

2. A method as recited in claim 1 wherein the step of forming comprises an extrusion consolidation step performed at a temperature of about 50° F. to about 200° F. below the γ' solvus temperature, and at a ram speed which is sufficiently low to prevent adiabatic heating of the superalloy.

3. A method as recited in claim 1 wherein the superalloy contains at least about 0.030 weight percent carbon.

4. A method as recited in claim 1 wherein the working step comprises an isothermal forging operation.

5. A method as recited in claim 1 wherein the pre-working hold temperature is about 75° F. to about 175° F. below the γ' solvus temperature, and the pre-working hold temperature is maintained for a duration of not more than about 25 hours.

6. A method as recited in claim 1 wherein the annealing temperature is about 50° F. to about 200° F. below the γ' solvus temperature.

7. A method as recited in claim 1 wherein the superalloy consists essentially of, in weight percent, about 12.0 to about 14.0 cobalt, about 15.0 to about 17.0 chromium, about 3.5 to about 4.5 molybdenum, about 1.5 to about 2.5 aluminum, about 3.2 to about 4.2 titanium, about 0.5 to about 1.0 niobium, about 0.01 to about 0.06 zirconium, about 0.01 to about 0.1 carbon, about 0.01 to about 0.04 boron, up to about 0.3 hafnium, up to about 0.01 vanadium, and up to about 0.01 yttrium, with the balance being essentially nickel and incidental impurities.

8. A method as recited in claim 1 further comprising the step of heating the worked article after the cooling step to a temperature and for a duration sufficient to stabilize the microstructure of the worked article, so as to render the worked article suitable for use at elevated temperatures of up to about 1500° F.

9. A method as recited in claim 1 wherein the working step comprises working the billet so as to maintain local strain rates below about 0,032 $sec^{-1}$.

10. A method as recited in claim 1 wherein the working step comprises working the billet so as to maintain the strain rate gradient throughout the billet below about 0.2 inch/inch per second-inch.

11. A method for forming an article from a γ' precipitation strengthened nickel-base superalloy having a γ' solvus temperature and a calculated γ' content in the range of about 30 to about 65 volume percent, the method comprising the steps of:

forming a billet by an extrusion consolidation method such that the billet has a very fine grain size of less than about ASTM 12 in order to achieve superplasticity of the superalloy during a subsequent working step;

heating the billet to a pre-working hold temperature of about 75° F. to about 175° F. below the γ' solvus temperature, and maintaining the pre-working hold temperature for a duration which prevents coarsening of the microstructure and a subsequent loss of superplasticity;

working the billet at a temperature below the γ' solvus temperature of the alloy so as to form a worked article, wherein the billet is worked so as to maintain local strain rates below a critical strain rate of about 0 032 $sec^{-1}$ and so as to maintain the strain rate gradient throughout the billet below a critical upper limit;

annealing the worked article at an annealing temperature of about 50° F. to about 200° F. below the γ' solvus temperature, and for a duration of at least about 8 hours;

heat treating the worked article to a temperature above the γ' solvus temperature of the superalloy for a duration sufficient to uniformly coarsen the grains of the article to at least about ASTM 9; and cooling the worked article at a rate sufficient to reprecipitate γ' within the worked article;

whereby nonuniform nucleation tendencies of the superalloy are significantly reduced so as to prevent random grain growth in the article.

12. A method as recited in claim 11 wherein the forming step is performed at a temperature of about 50° F. to about 200° F. below the γ' solvus temperature and at a ram speed which is sufficiently low to prevent adiabatic heating of the superalloy, such that a minimum strain rate sensitivity of about m=0.3 is achieved in the superalloy.

13. A method as recited in claim 11 wherein the working step comprises an isothermal forging operation.

14. A method as recited in claim 11 wherein the annealing temperature is about 75° F. to about 175° F. below the γ' solvus temperature.

15. A method as recited in claim 11 wherein the superalloy consists essentially of, in weight percent, about 12.0 to about 14.0 cobalt, about 15.0 to about 17.0 chromium, about 3.5 to about 4.5 molybdenum, about 1.5 to about 2.5 aluminum, about 3.2 to about 4.2 titanium, about 0.5 to about 1.0 niobium, about 0.01 to about 0.06 zirconium, about 0.01 to about 0.1 carbon, about 0.01 to about 0.04 boron, up to about 0.3 hafnium, up to about 0.01 vanadium, and up to about 0.01 yttrium, with the balance being essentially nickel and incidental impurities.

16. A method as recited in claim 11 further comprising the step of heating the worked article after the cooling step to a temperature and for a duration sufficient to stabilize the microstructure of the worked article, so as to render the worked article suitable for use at elevated temperatures of up to about 1500° F.

17. A method as recited in claim 11 wherein the working step comprises working the billet so as to maintain local strain rates below about 0.032 $sec^{-1}$.

18. A method as recited in claim 11 wherein the working step comprises working the billet so as to maintain the strain rate gradient throughout the billet below about 0.2 inch/inch per second-inch.

19. A method as recited in claim 11 wherein the superalloy contains at least about 0.030 weight percent carbon.

20. A method for forming an article from a $\gamma'$ precipitation strengthened nickel-base superalloy having a $\gamma'$ solvus temperature and a calculated $\gamma'$ content in the range of about 30 to about 65 volume percent, the method comprising the steps of:

forming a billet by an extrusion consolidation method performed at a temperature of about 50° F. to about 200° F. below the $\gamma'$ solvus temperature and at a ram speed which is sufficiently low to prevent adiabatic heating of the superalloy, such that the billet is characterized by a very fine grain size of about ASTM 14 to about ASTM 16 and a minimum strain rate sensitivity of about m=0.3 in order to achieve superplasticity of the superalloy during a subsequent isothermal forging operation;

heating the billet to a pre-working hold temperature of about 75° F. to about 175° F. below the $\gamma'$ solvus temperature, and maintaining the pre-working hold temperature for a duration of at not more than 25 hours so as to prevent coarsening of the microstructure and a subsequent loss of superplasticity;

isothermally forging the billet at a temperature below the $\gamma'$ solvus temperature of the alloy so as to form a worked article, wherein the billet is worked so as to maintain local strain rates below a critical strain rate of about 0 032 $sec^{-1}$, and so as to maintain the strain rate gradient throughout the billet below a critical upper limit of about 0.2 inch/inch per second-inch;

annealing the worked article at an annealing temperature of about 75° F. to about 175° F. below the $\gamma'$ solvus temperature and for a duration of about 8 hours to about 96 hours;

heat treating the worked article to a temperature above the $\gamma'$ solvus temperature of the superalloy for a duration sufficient to uniformly coarsen the grains of the article to at least about ASTM 9; and cooling the worked article at a rate sufficient to reprecipitate $\gamma'$ within the worked article;

whereby nonuniform nucleation tendencies of the superalloy are significantly reduced so as to prevent random grain growth in the article.

* * * * *